US008668055B2

(12) United States Patent
Spirgi

(10) Patent No.: US 8,668,055 B2
(45) Date of Patent: Mar. 11, 2014

(54) METHOD FOR RELEASING A LOAD-CARRYING APPARATUS OR A COMPENSATING WEIGHT OF AN ELEVATOR FROM A STOPPING POSITION

(75) Inventor: Erich Spirgi, Hergiswil (CH)

(73) Assignee: Inventio AG, Hergiswil (CH)

( * ) Notice: Subject to any disclaimer, the term of this patent is extended or adjusted under 35 U.S.C. 154(b) by 443 days.

(21) Appl. No.: 13/128,993

(22) PCT Filed: Nov. 27, 2009

(86) PCT No.: PCT/EP2009/065974

§ 371 (c)(1),
(2), (4) Date: May 12, 2011

(87) PCT Pub. No.: WO2010/063650

PCT Pub. Date: Jun. 10, 2010

(65) Prior Publication Data

US 2011/0290591 A1 Dec. 1, 2011

(30) Foreign Application Priority Data

Dec. 4, 2008 (EP) ..... 08170669

(51) Int. Cl.
*B66B 1/34* (2006.01)

(52) U.S. Cl.
USPC ..... 187/393; 187/351; 187/289; 187/287

(58) Field of Classification Search
USPC ..... 187/251, 277, 287, 289, 293, 302, 305, 187/351, 356, 359, 373, 391, 393, 401, 404, 187/406, 411, 412
See application file for complete search history.

(56) References Cited

U.S. PATENT DOCUMENTS

| | | | | |
|---|---|---|---|---|
| 5,323,878 | A * | 6/1994 | Nakamura et al. | 187/264 |
| 8,267,224 | B2 * | 9/2012 | Gremaud et al. | 187/288 |
| 2012/0152659 | A1 * | 6/2012 | Husmann et al. | 187/373 |
| 2012/0217097 | A1 * | 8/2012 | Jokinen | 187/276 |
| 2013/0248296 | A1 * | 9/2013 | Husmann | 187/251 |

FOREIGN PATENT DOCUMENTS

| | | | |
|---|---|---|---|
| EP | 1213247 | A1 | 6/2002 |
| EP | 1641700 | B1 | 5/2007 |
| JP | 4251083 | A | 9/1992 |
| JP | 2003246561 | A | 9/2003 |

* cited by examiner

*Primary Examiner* — Anthony Salata
(74) *Attorney, Agent, or Firm* — Fraser Clemens Martin & Miller LLC; William J. Clemens

(57) ABSTRACT

An elevator load receiving apparatus or a compensating weight connected thereto by a suspension device is released from a safety device in a stopping position after downward travel, the load receiving apparatus and the compensating weight being moved by a drive unit including a reversible electric motor and a traction sheave engaging the suspension device. Many safety devices, after stopping must be moved counter to the travelling direction of the load receiving apparatus before stopping in order to release (moved upwards in the case of stopping after downward travel). The safety device is easily released by activating the drive unit for a time (tmax1) or a certain distance (smax) with a predetermined torque (Mmax) counter to the direction of release and subsequently activated as abruptly as possible with the predetermined torque in the direction of release. This method can be used to release the compensating weight from its stopped position.

17 Claims, 5 Drawing Sheets

METHOD FOR RELEASING A LOAD-CARRYING APPARATUS OR A COMPENSATING WEIGHT OF AN ELEVATOR FROM A STOPPING POSITION

FIELD OF THE INVENTION

The invention relates to a method for releasing a load receiving means or apparatus of an elevator from a safety device in a stopping position after downward travel, wherein the load receiving apparatus is connected to a compensating weight by a suspension means and can be moved by a drive unit.

BACKGROUND OF THE INVENTION

Elevators consist in essence of a load-carrying means and a compensating weight, which are connected together by a suspension means. The suspension means is usually formed of a plurality of suspension ropes (steel ropes); there are, however, also synthetic-fiber ropes, flat belts, lengthwise-ribbed belts, and similar. The load-carrying means is (particularly in the case of passenger elevators) usually an elevator car.

Elevators, particularly their load-carrying means, must be equipped with safety devices. Should a specified speed in a downward direction be exceeded, the safety device triggers and brakes the elevator. Such safety devices that act in the downward direction are particularly intended for the case of a breakage of the suspension means. In this case, the elevator accelerates downward at 1 g (where g is the acceleration due to gravity). The safety devices must therefore generate a substantially greater force than the weight force (weight force being the mass multiplied by the acceleration due to gravity), since otherwise the elevator would not decelerate. Similar considerations apply to the case where the compensating weight is equipped with a safety device.

High-speed elevators must also be equipped with a safety device that also acts in the case of upward travel, which triggers at excessively fast upward travel. These safety devices that act in the case of upward travel are activated in, for example, the third-highest floor and brake the elevator, should the control system fail and the upward travel not be decelerated in good time before reaching the highest floor. Safety devices that act in the case of upward travel must decelerate considerably less slowly, since, in the case of deceleration greater than the acceleration due to gravity, the momentum of the passengers would cause them to be thrown against the ceiling of the elevator. The forces that must be generated by the safety device in the upward direction are therefore correspondingly smaller than the forces that must be generated for downward travel.

The safety devices must be self-locking: once they have engaged, they hold the elevator until they are released. Many safety devices are designed so that they can be released by the elevator, or its load-carrying means, being moved counter to the direction of engagement, since this does not require a separate mechanism to release the safety devices. That is to say, if the safety device engaged while on a downward travel or an upward travel, the elevator is moved either with the drive apparatus, or with an auxiliary device, counter to the direction of travel, as a result of which the safety device releases itself.

Problematical in this case is that the releasing forces may be very large, so that the drive apparatus cannot generate these high forces. The forces to release the safety device are particularly high if the safety device triggered during downward travel, since in this case the braking forces are also correspondingly large.

To solve this problem, in the generic EP 1213247 A1 the proposal is made that the load-carrying means has a certain play relative to the safety device. On engagement of the safety device, the drive unit can therefore first accelerate the load-carrying unit for a few centimeters before the load-carrying means strikes the safety device and triggers the latter, whereby not only the force of the drive unit acts but also the much greater momentum force of the elevator. The safety device is hence struck free like with a hammer.

In this method it is necessary for the safety device to be designed in such manner that when the safety device is in engagement, the load-carrying means can be slightly moved. Without such a safety device, this method cannot be applied. This method therefore requires a mechanical modification of the elevator.

Furthermore, from EP 1641700 B1 a method for releasing a load-carrying means from engagement has become known in which a wire rope is fastened to the load-carrying means and to the compensating weight, which, at the bottom of the hoistway, is reversed around a free-running pulley which is loaded with a tension weight. Depending on whether the safety device engaged during upward travel or downward travel, the wire rope is pulled in one or other direction by means of a chain hoist. In this method, the safety device can be embodied arbitrarily: it is not necessary for the safety device in the engaged position to allow a limited movement of the load-carrying means. However, a disadvantage of this method is that, to release the load-carrying means from engagement, an additional chain hoist with corresponding drive must be fastened to the wire rope.

SUMMARY OF THE INVENTION

An objective of the invention is to avoid these disadvantages and to propose a method of the type stated at the outset which can be used independent of an even slight displaceability of the load-carrying means in the engaged position of the safety device and requires no additional devices. It should also be usable for an emergency-braking of the compensating weight.

Through the proposed measures, it is assured that after an emergency-braking of the load-carrying means from a downward travel, through application of a control signal to the drive in the direction of a downward travel, the compensating weight is raised and the latter thereby brought to a higher level of potential energy. Upon reversal of the drive in the direction of an upward travel of the load-carrying means to release the safety device, the compensating weight falls downward, whereby its potential energy is released and the latter complements the torque of the drive, whereby the torque required to release the safety device is generated.

Similar applies for the engagement of the compensating weight when this was in downward travel (and the load-carrying means therefore in upward travel): i.e. through application of a control signal to the drive in the direction of an upward travel of the load-carrying means, the load-carrying means is raised, and the latter thereby brought to a higher level of potential energy. After reversal of the drive in the direction of a downward travel of the load-carrying means to release the safety device, the load-carrying means falls downward, whereby its potential energy is released, and the latter complements the torque of the drive, whereby the torque required to release the safety device is attained.

The following remarks relate to emergency-braking of the load-carrying means (the elevator car), because this is the more frequent case; however, they also apply analogously for emergency-braking of the compensating weight.

The drive cannot raise the compensating weight to an arbitrary height while the safety device blocks the elevator. There are two possibilities: either the motor is not powerful enough to raise the compensating weight so far that the suspension means to the elevator car are completely detensioned, so that the motor blocks; or, the motor is sufficiently powerful, in which case the suspension means begin to slip on the traction sheave as soon as the suspension means to the car are detensioned, because then they do not rest against the traction sheave with sufficient force.

Correspondingly, in embodiments of the invention, provision can be made for two possibilities:

Preferably, the time for application of a control signal to the drive unit with predetermined torque in order to—if the safety device is arranged on the load-carrying means—raise the compensating weight, or—if the safety device is arranged on the compensating weight—to raise the load-carrying means, is limited, i.e. the predefined torque is only applied for a specific time. This is expedient if the force of the motor is insufficient to completely detension the suspension means to the elevator car. The time must be so selected that the compensating weight is maximally raised.

Alternatively, it can be foreseen that the angle of rotation of the traction sheave during application of a control signal to the drive unit in order to—if the safety device is arranged on the load-carrying means—raise the compensating weight, or—if the safety device is arranged on the compensating weight—raise the load-carrying means, is limited. This is expedient if the force of the motor is sufficient to cause the traction means to slip on the traction sheave.

Self-evidently, it is also possible and expedient to provide both measures, and to apply the predetermined torque for so long until either the specified time has elapsed, or the traction sheave has turned correspondingly far, depending on which occurs first.

At first sight it may appear as if, under these circumstances, the compensating weight can be only minimally raised. This is, however, not the case, as has become apparent in the context of the present invention, since the elasticity of the suspension means is obviously so great that the compensating weight can be raised a few centimeters in any case, before one of the two described situations (blocking of the motor or slipping of the suspension means on the traction sheave) occurs. However, the energy that is thereby gained acts strongly positively on the subsequent reversal of the direction of rotation of the traction sheave, because the compensating weight, until renewed complete tensioning of the suspension means, attains a substantial speed, which aids release of the safety device. If this does not succeed at the first attempt, this operation can be repeated, as will be explained further below.

If the drive unit of the elevator has a frequency-converter-controlled motor, it is favorable for the motor voltage and current to be determined by vector control, and for the magnetic flux and torque to be controlled independently. This results in particularly favorable conditions in relation to the control of the drive: i.e. both the rotational speed (hence the speed of the elevator) and the torque can be limited independent of each other, which particularly in the present application is important.

A particular advantage of the method according to the invention is that it can be executed without mechanical modifications and hence, in the normal case, no on-site visit by a technician is required. For this purpose it is, however, necessary that the control system recognizes the direction in which the engaged elevator must be released. For this purpose, in embodiments of the invention, provision can be made for two possibilities: viz. that the control system, to determine the direction of release, takes as reference the last-specified reference speed, or that the control system, to determine the direction of release, takes as reference the sign of the last-recorded speed of the load-carrying means. The latter possibility is expedient if the travel is continuously stored in the operating control system; should this not be the case, the reference speed is taken as reference.

As already indicated above, the load-carrying means, or the compensating weight, need not already release on the first execution of the method according to the invention; in this case, the method will be executed several times in succession. For this purpose, however, it is necessary to recognize whether the engagement has released or not. Also for this purpose, according to embodiments of the invention, two possibilities are foreseen: viz. that a travel distance of the load-carrying means or of the compensating weight, or the angle of rotation of the traction sheave, during the action of the torque on the suspension means, so as to—if the safety device is arranged on the load-carrying means—move the compensating weight downward, or—if the safety device is arranged on the compensating weight—move the load-carrying means downward, measured and compared with a reference value $s_{max}$, and the previous method steps are repeated, if this reference value is not attained, or that the actually attained torque, in order to—if the safety device is arranged on the load-carrying means—move the compensating weight downward, or—if the safety device is arranged on the compensating weight—to move the load-carrying means downward, measured and compared with a reference value, and that the previous method steps are repeated if this reference value is exceeded.

Stated simply, either the travel distance or the force is measured; a "large" travel distance or a "small" force means that the safety device was released (and the elevator moves free). If, on the other hand, only a "small" distance is traveled, or a "large" force is required, the elevator is still emergency-braked (i.e. is still blocked).

Hence, in this manner, the method according to the invention is executable also without on-site attendance of a technician, which correspondingly reduces the maintenance outlay.

DESCRIPTION OF THE DRAWINGS

The invention is now explained in greater detail by reference to the drawings. Shown are in.

DETAILED DESCRIPTION OF THE INVENTION

Figure 1:
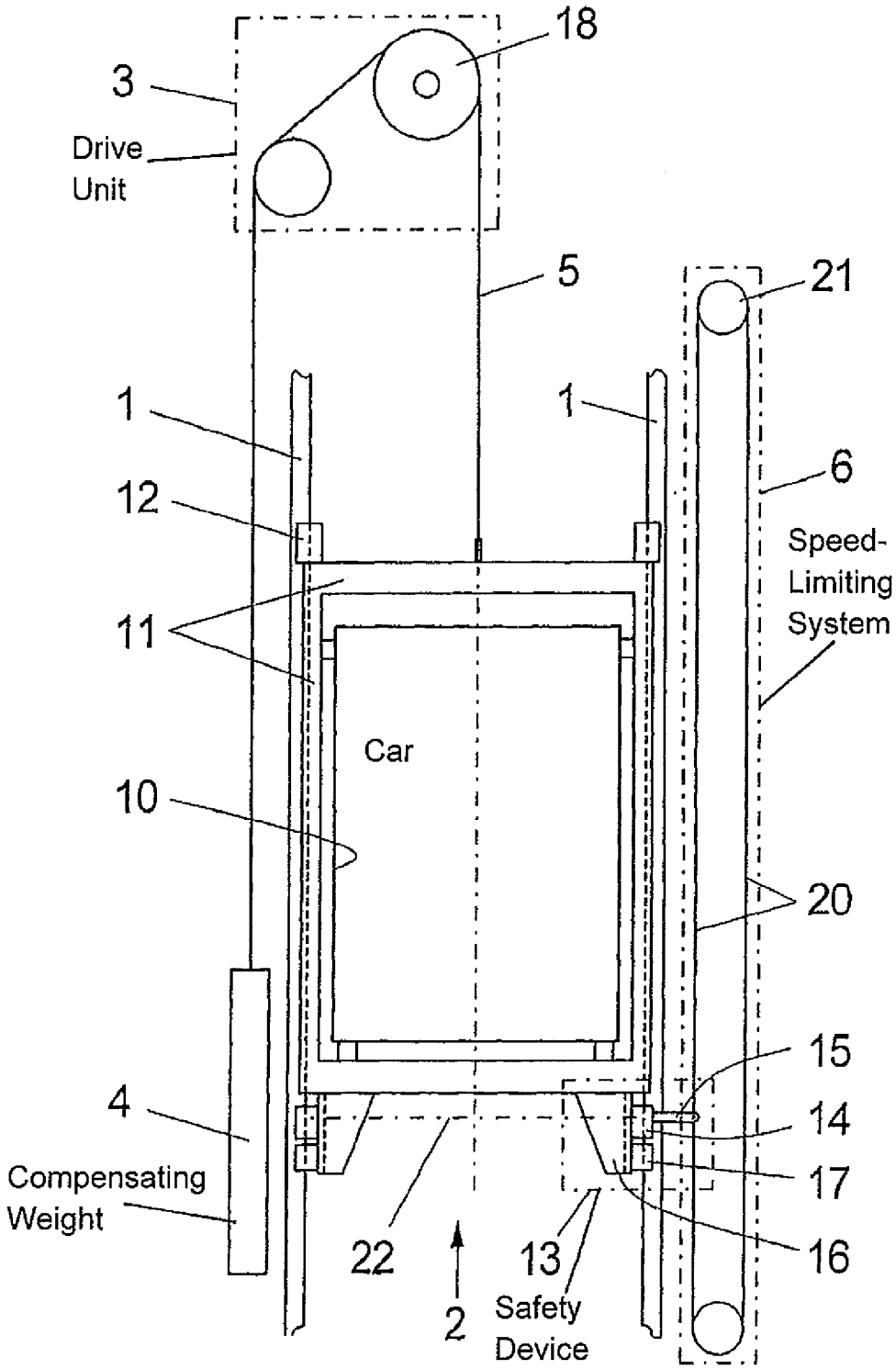
FIG. 1 a diagrammatic representation of an elevator with a safety device.

FIG. 1 shows diagrammatically an elevator system which is equipped with a safety device. This consists essentially of a load-carrying means or apparatus 2 which is guided on guiderails 1, a drive unit 3, a compensating weight 4, a suspension means or device 5 (e.g. a number of suspension ropes) and a speed-limiting (overspeed governor) system 6. The load-carrying means 2 contains a car 10 which, depending on the embodiment, can have an additional car frame 11, upper guide shoe 12, and two safety devices 13. Such a safety device 13 is composed of a holding means 14 and an emergency-brake console 16, which is joined to the load-carrying means 2, to which the holding means 14 is fastened and which additionally bears two lower guide shoes 17.

The load-carrying means 2 and the compensating weight 4 hang on the suspension means 5 which is passed over a traction sheave 18 of the drive unit 3 and is moved up and down along the guiderails by the drive system that is formed from these components. In the case of exceeding of a speed limit, an overspeed governor rope 20 which, in the normal case, is moved synchronously with the load-carrying means, is blocked by an overspeed governor 21, which, via a tripping lever 15, activates holding means 14 of the two safety devices 13 which are joined together via a coupling mechanism 22. Through use of the kinetic energy of the load-carrying means 2, gripping mechanisms which are contained in the safety device generate a gripping effect between the holding means 14 and the guiderails 1.

Figure 2:
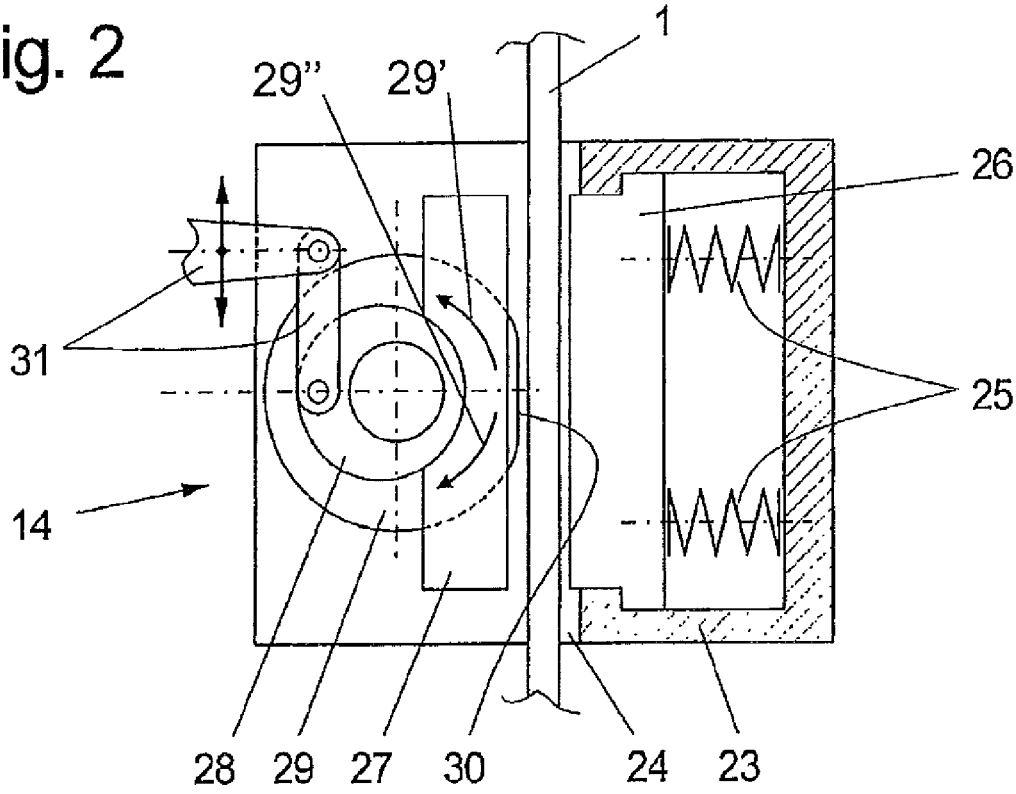
FIG. 2 an exemplary embodiment of a holding means which acts in both directions of travel of the load-carrying means.

FIG. 2 shows a possible embodiment of a holding means 14. Indicated with 1 is the guiderail of a load-carrying means. A base unit 23 has a recess 24 into which the guiderail 1 projects. Arranged in the base unit 23 on one side of the recess 24 is a first brake shoe 26, which is supported by pre-tensioned spring elements 25. Present on the other side of the recess and borne in the base unit 23 is a second brake shoe 27, which rests on an eccentric 28. The latter is non-rotationally joined to a cam 29, the side of whose periphery would touch the guide shoe, which, however, on its circumference has a flat point 30, which, in the spring-centered normal position of the cam 29, prevents this contact.

A triggering mechanism 31 which, on occurrence of overspeed, is triggered by the overspeed governor rope 20 via the tripping lever 15 (FIG. 1), causes a turning of the eccentric 28 with the cam 29 so far that the unflattened part of the periphery of the cam 29 contacts the guiderail 1. In consequence of the relative movement between the guiderail 1 and the cam 29, the latter, along with the eccentric 28, is turned so far until a (here not shown) stop terminates the turning, whereupon the cam 29 is forced to slide on the guiderail 1. The twisting of the eccentric 28 causes the latter to move the second brake shoe 27 that rests upon it against the guiderail and grips the latter between the two brake shoes 26, 27, the elastic support of the first brake shoe 26 determining the gripping force depending on the stroke of the eccentric.

Depending on the direction of movement of the load-carrying means 2 that prevails at the instant of triggering, the cam 29, along with the eccentric 28, is twisted in the positive direction of twisting 29' or the negative direction of twisting 29", "positive direction of twisting" meaning in the counter-clockwise direction, "negative direction of twisting" meaning in the clockwise direction. The maximum angles of rotation, which are limited by stops, are of different magnitudes for the positive and negative directions of rotation, as a result of which different eccentric strokes, with correspondingly different gripping and braking forces, arise, which are adapted to the requirements for braking from downward or upward movement. Viz., as explained above, the braking forces in the case of upward movement must be lower than in the case of downward movement, as a result of which the gripping forces are also correspondingly smaller.

To unlock the self-locking grip that prevails between the holding means 14 and the guiderail 1 after an emergency-braking, this holding means 14 must be moved counter to the direction of movement of the load-carrying means 2 that prevailed before the emergency-braking, which usually takes place by displacing the load-carrying means 2 with the aid of the drive unit 3. The eccentric 28 is thereby turned back into its spring-centered normal position by the cam 29, during which no further gripping forces are generated. The unlocking movement requires a substantial expenditure of force, particularly if an emergency-braking from downward movement must be unblocked.

Figure 3:
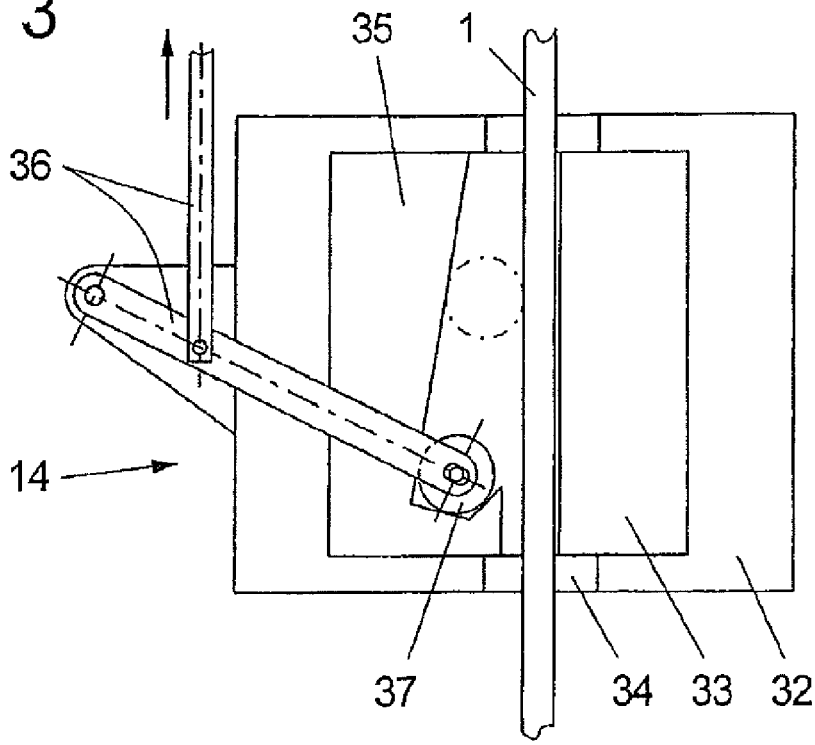
FIG. 3 an exemplary embodiment of a holding means which is only effective in the downward direction of travel of the load-carrying means.

FIG. 3 shows a further possible embodiment of the holding means 14. A base unit 32 has a recess 34 into which the guiderail 1 projects. Embedded in the base unit 32 on one side of the recess is a cuboid brake plate 33, and, on the opposite side, the body 32 contains a gripping ramp 35. A tripping mechanism 36 which, via the tripping lever 15 (FIG. 1), is connected to the overspeed governor rope 20 (FIG. 1) supports a cylindrical gripping body 37, which is arranged in the space between the gripping ramp 35 and the guiderail 1. On tripping of the safety device, the blocked overspeed governor rope causes the tripping mechanism 36 to raise the gripping body 37 and bring it into contact with the guiderail 1 and the gripping ramp 35 that moves relative to the latter, so that the gripping body 37 wedges between the guiderail 1 and the gripping ramp 35. Through friction and deformation of the guiderail 1, the load-carrying means is braked.

In order to unblock the self-locking gripping between this holding means 14 and the guiderail 1 that prevails after an emergency-braking, this holding means 14 must be moved in opposite direction to the direction of movement of the load-carrying means 2 that prevailed before the emergency-braking, which usually takes place though displacement of the load-carrying means with the aid of the drive unit. The cylindrical gripping body 37 thereby moves out of the wedge gap, so that no further gripping forces are present. The unblocking movement requires a considerable application of force.

Figure 4:
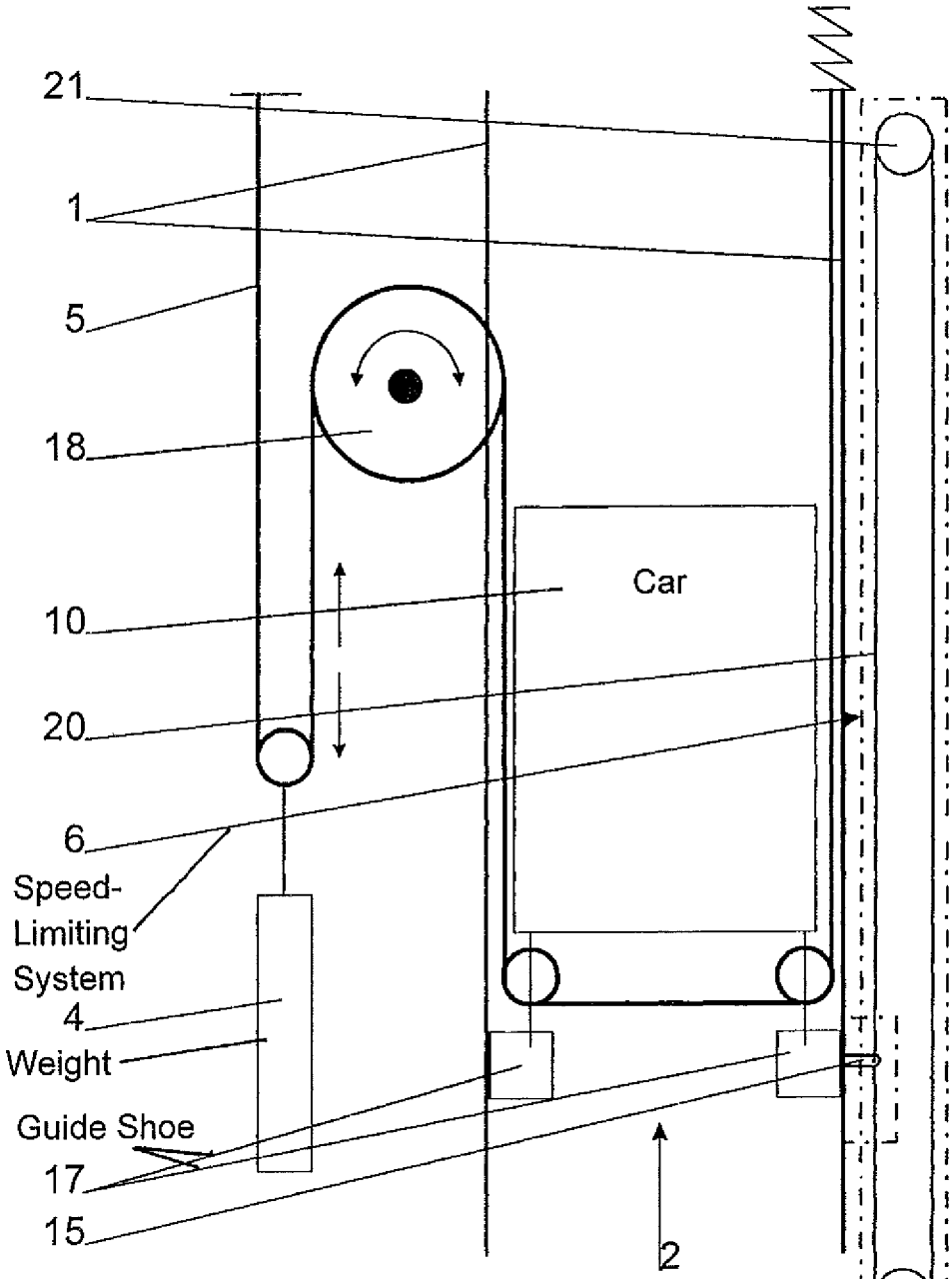
FIG. 4 a diagrammatic representation of an elevator, which is driven in different manner than in FIG. 1.

FIG. 4 shows a drive of the elevator which is somewhat modified relative to FIG. 1. Identical parts are referenced with the same reference numbers as in FIG. 1 and are not explained again. Compared with FIG. 1, FIG. 4 is much more diagrammatic, since of importance here is only the changed drive. In particular, the upper guide shoes 12 are not shown, and the holding means 14 are also not visible; they can be integrated in the lower guide shoe 17.

The essential difference relative to FIG. 1 is that, here, not only the load-carrying means 2 (hence the car 10) but also the compensating weight 4 is held in free-running pulleys. As a result, only half as much force acts on the suspension means 5, or, in other words, the suspension means 5 can transmit twice as much force onto the car 10 and the compensating weight 4. A further difference that results is that the traction sheave 18 has an angle of wrap of 180°, in other words, a substantially greater angle of wrap than the embodiment according to FIG. 1.

By this means a greater torque can be transmitted, hence more force applied to the suspension means 5. Since the force is additionally doubled by the free-running pulleys, the forces that are transmitted onto the car 10, or onto the compensating weight 4, in this embodiment are very substantially greater than in the embodiment according to FIG. 1.

Since the maximum transmissible force plays an important role in the method according to the invention that will now be described, the embodiment according to FIG. 4 is better suited to this method than the embodiment according to FIG. 1.

Figure 5:
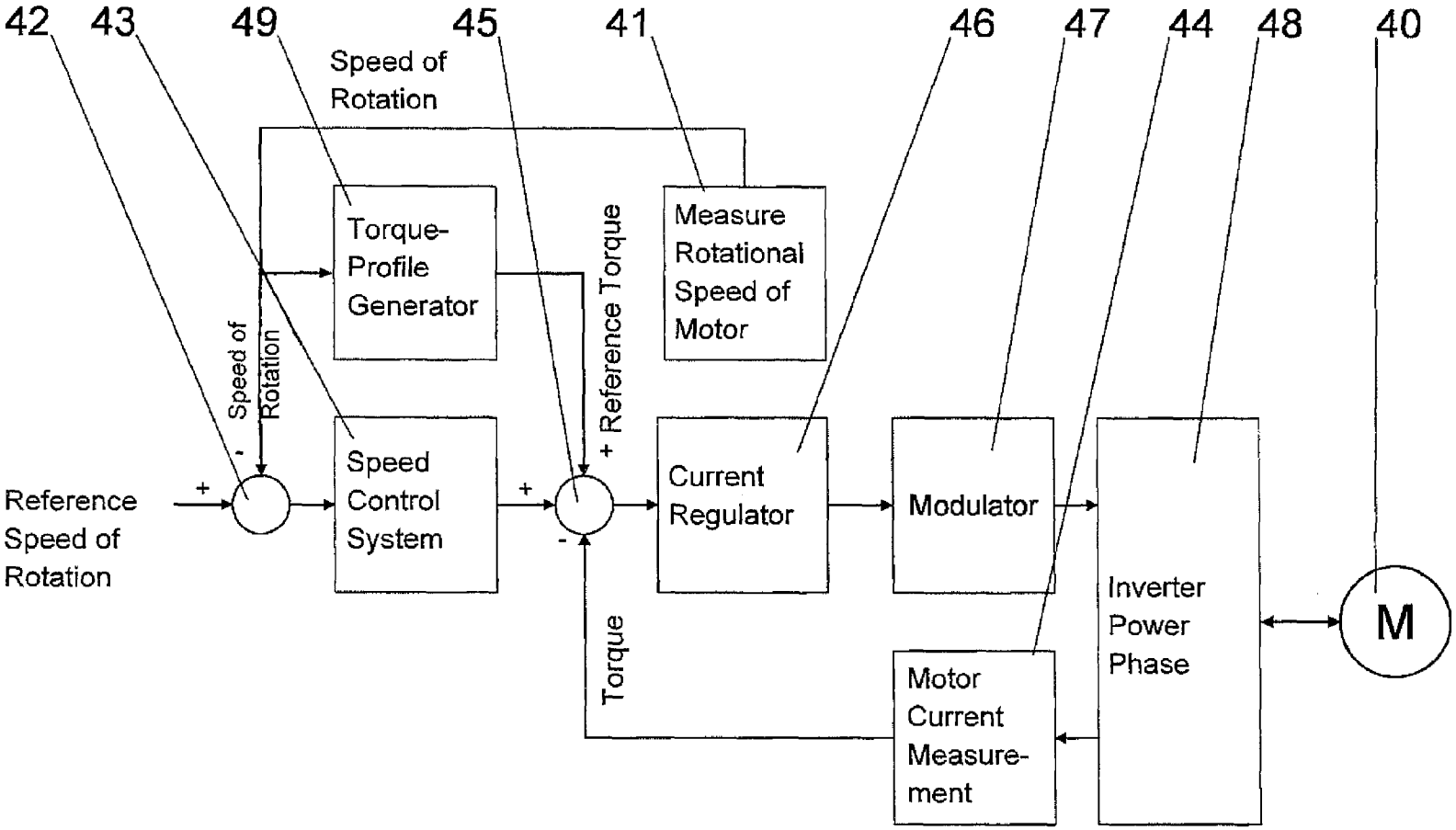
FIG. 5 a block schematic diagram of a control system for executing the method according to the invention.

As stated, the gripping forces in the case of an emergency-braking from the upward direction are relatively low, so that, by driving in the downward direction, the drive motor can release the safety device. However, in the case of an emergency-braking from the downward direction, the required forces are substantially greater, and it is here that the normal drive often fails. For this reason, according to the invention, after an emergency-braking from a downward travel, the motor is controlled in a particular manner, as will now be explained by reference to FIGS. 5 and 6.

Block 41 "Measure rotational speed of motor" (see FIG. 5) supplies the rotational speed of the motor (and hence a measure of the speed of the elevator). In a difference amplifier 42, the rotational speed is compared with a reference rotational speed. The difference signal is fed to Block 43 "Speed control system", which supplies corresponding output signals that depend on the difference: if the difference is 0, it supplies a small correction signal, if the difference is very large, it stops the elevator.

Block 44 "Motor current measurement" supplies the motor current (and hence a measure for the torque of the motor, which is also a measure of the force that acts on the load-carrying means or the compensating weight). In a further difference amplifier 45, the torque is compared with a reference torque. This difference amplifier 45 also receives the output signal of Block 43 "Speed control system" as additional input signal. The resulting output signal is fed to Block 46 "Current regulator". In Block 47 "Modulator", the output signal of the latter is converted into control signals for the switch of the "Inverter power phase" 48, wherein the switching duration of the switches determines the current in the motor 40.

Special about this circuit is that, for the reference torque, a separate Block 49 "Torque-profile generator" is provided, which can supply the pattern of torque required according to the method according to the invention (which will be explained according to FIG. 6).

Figure 6:
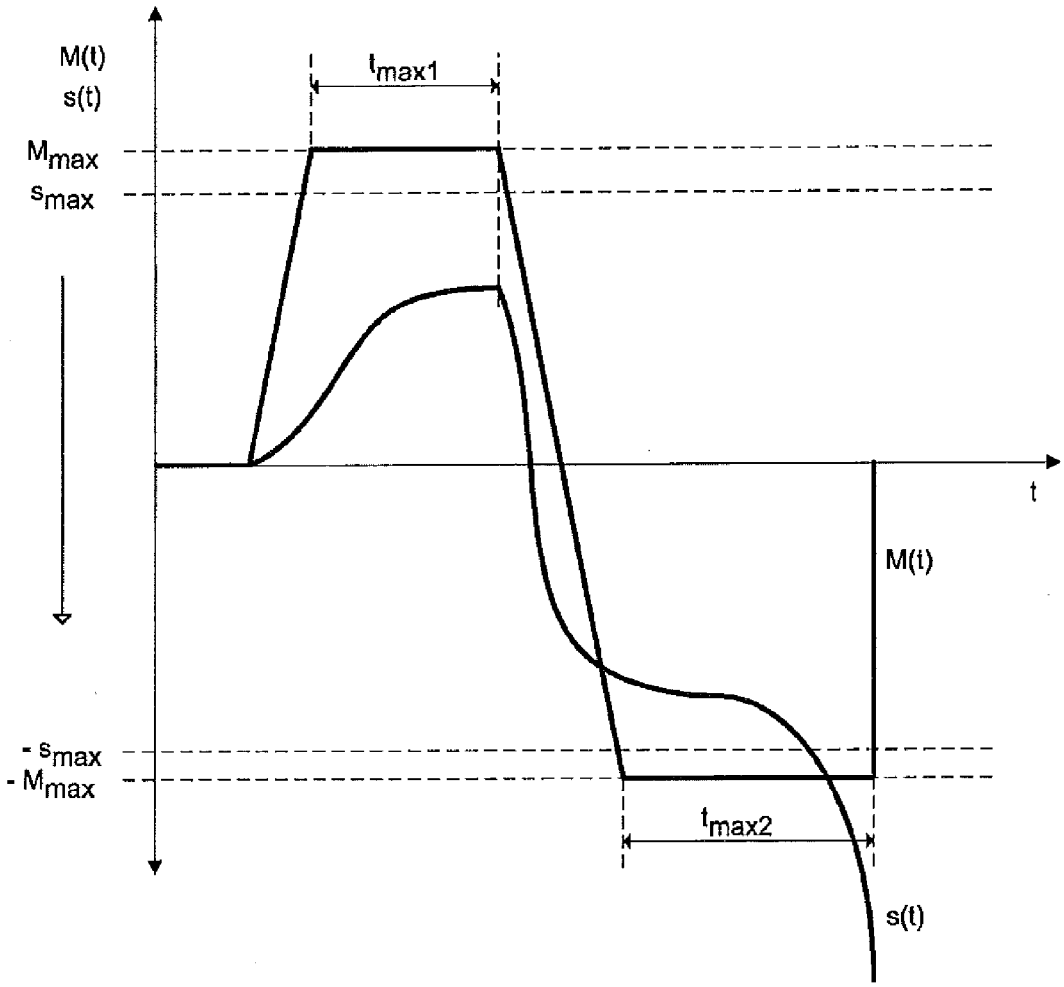
FIG. 6 a diagram of a torque-pattern of the drive and the corresponding travel distances foreseen according to the method according to the invention.

FIG. 6 shows the pattern of the torque M(t) of the drive and of the corresponding travel distances s(t) in the application of the method according to the invention as they depend on the time t.

From this diagram it can be seen that the drive is first caused to move for a maximum time period $t_{max1}$ in a direction that is opposite to the direction of release of the safety device 13 (hence also in the direction of downward travel). (In FIG. 6, the direction of release is indicated by an arrow at the left of the diagram.) The pattern of torque is thereby specified by the torque-profile generator 49 and converted by blocks 46, 47 and 48 into current values in such manner that the motor 40 supplies exactly the specified pattern of torque. Any deviations are detected from measurement of the motor current and regulated out by the difference amplifier 45.

From this pattern of torque, corresponding travel distances result, which are registered by a motor encoder, counting in negative direction corresponding to the direction of release of the safety device 13.

Designated with $M_{max}$ is the pre-determined torque which is specified by the torque-profile generator 49. Designated with $s_{max}$ is a safety limit for the travel distance. In the case shown, this safety limit $s_{max}$ is not attained, because the motor 40 threatens to block already when the time $t_{max1}$ has elapsed. If the suspension means were to slip on the traction sheave 18, $s_{max}$ would be exceeded within the time period $t_{max1}$. If either $s_{max}$ or $t_{max1}$ is exceeded, the motor 40 is switched over to the opposite direction, to avoid unsafe states, in particular blocking ($t_{max1}$) of the motor 40 or slipping of the suspension means on the traction sheave 18 ($s_{max}$).

After the switchover, the motor 40 again has applied to it the predetermined torque $M_{max}$ for a time period $t_{max2}$. If the elevator comes free during this time period (and s assumes a correspondingly large negative value as shown in the diagram), travel can normally continue to the next floor. If not, the method according to the invention must be repeated.

According to the method according to the invention, the drive unit is hence first caused to move in the direction opposite to the direction of release of the safety device 13, as a result of which the load-carrying means 2 is caused to move downward, so that between the traction sheave 18 and the load-carrying means 2, the suspension means 5 is detensioned, and raising of the compensating weight 4 occurs. After the drive unit 3 is switched over, it changes its direction of rotation, and the energy that is stored in the compensating weight 4 supports the drive unit 3 in moving the load-carrying means 2 in the direction of release of the safety device 13 (hence upward) and thereby releasing the latter.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for releasing a safety device from an emergency-stopped position after downward travel, the safety device being arranged on a load-carrying apparatus or on a compensating weight of an elevator, the load-carrying apparatus being connected via a suspension device to the compensating weight, and a drive unit including a reversible electric motor and a traction sheave, over which the suspension device is passed, moves the load-carrying apparatus and the compensating weight, comprising the steps of:

operating the drive unit to initially apply a predetermined torque ($M_{max}$) to the suspension device in a release direction of rotation whereby, if the safety device is arranged on the load-carrying means, to raise the compensating weight, or, if the safety device is arranged on the compensating weight, to raise the load-carrying apparatus; and thereafter operating the drive unit to act in a direction of rotation opposite the release direction to apply the predetermined torque to the suspension device, whereby the raised compensating weight or the raised load-carrying apparatus respectively is moved downward.

2. The method according to claim 1 including for a limited time ($t_{max1}$) applying to the drive unit a control signal representing the predetermined torque.

3. The method according to claim 1 including applying a control signal to the drive unit to limit an angle of rotation of the traction sheave to a safety limit ($s_{max}$) of travel distance.

4. The method according to claim 1 wherein the electric motor of the drive unit is controlled by a frequency converter, and including determining motor voltage and currents by vector regulation and regulating magnetic flux and torque independently.

5. The method according to claim 1 including providing a control system that refers to a leading sign of a last-specified reference speed for determining the release direction.

6. The method according to claim 1 including providing a control system that refers to a leading sign of a last-registered speed of the load-carrying apparatus for determining the direction of release.

7. The method according to claim 1 including measuring a value of travel distance of the load-carrying apparatus or of the compensating weight, or measuring a value of an angle of rotation of the traction sheave, while the predetermined torque is acting on the suspension device in the release direction, comparing the measured value with a reference value ($s_{max}$), and repeating the method steps if the reference value is not attained.

8. The method according to claim 1 including measuring a value of actual torque generated by the electric motor and acting on the suspension device in the release direction, comparing the measured value with a reference value, and repeating the method steps if the reference value is not attained.

9. A method for releasing a safety device from an emergency-stopped position after downward travel, the safety device being arranged on a first elevator component, the first elevator component being connected via a suspension device to a second elevator component, and a drive unit engaging the suspension device for moving the first and second elevator components, comprising the steps of:

operating the drive unit to initially apply a predetermined torque to the suspension device in a release direction of rotation to raise the second elevator component; and thereafter operating the drive unit to act in a direction of rotation opposite the release direction to apply the predetermined torque to the suspension device, whereby the raised second elevator component is moved downward.

10. The method according to claim 9 including for a limited time applying to the drive unit a control signal representing the predetermined torque.

11. The method according to claim 9 including applying a control signal to the drive unit to limit an angle of rotation of a traction sheave engaging the suspension device to a safety limit of travel distance.

12. The method according to claim 9 wherein the drive unit includes an electric motor controlled by a frequency converter, and including determining motor voltage and currents by vector regulation and regulating magnetic flux and torque independently.

13. The method according to claim 9 including providing a control system that refers to a leading sign of a last-specified reference speed for determining the release direction.

14. The method according to claim 9 including providing a control system that refers to a leading sign of a last-registered speed of the first elevator component for determining the direction of release.

15. The method according to claim 9 including measuring a value of travel distance of the second component, or measuring a value of an angle of rotation of a traction sheave of the drive unit, while the predetermined torque is acting on the suspension device in the release direction, comparing the measured value with a reference value, and repeating the method steps if the reference value is not attained.

16. The method according to claim 9 including measuring a value of actual torque generated by the drive unit and acting on the suspension device in the release direction, comparing the measured value with a reference value, and repeating the method steps if the reference value is not attained.

17. The method according to claim 9 including measuring a travel distance of the second component in the release direction and measuring an elapsed time of rotation in the release direction, and switching the drive unit to the direction of rotation opposite the release direction if a safety limit for the travel distance is exceeded or if a maximum elapsed time is exceeded.

* * * * *